US007299734B2

(12) United States Patent
Holloway

(10) Patent No.: US 7,299,734 B2
(45) Date of Patent: Nov. 27, 2007

(54) SYNCHRONOUSLY/SYNERGETICLY TIMED FUSE PROCEDURE OR PROCESS

(76) Inventor: Craig L Holloway, 802 7th St., GWS, CO (US) 81601

( * ) Notice: Subject to any disclaimer, the term of this patent is extended or adjusted under 35 U.S.C. 154(b) by 0 days.

(21) Appl. No.: 10/643,373

(22) Filed: Aug. 20, 2003

(65) Prior Publication Data

US 2005/0081705 A1 Apr. 21, 2005

(51) Int. Cl.
*B64D 1/04* (2006.01)

(52) U.S. Cl. ..... 89/1.11; 102/200; 102/310; 102/311; 102/332

(58) Field of Classification Search ..... 89/1.1, 89/1.11; 102/310, 200, 311, 332; 181/116
See application file for complete search history.

(56) References Cited

U.S. PATENT DOCUMENTS 3,951,066 A * 4/1976 Schroeder ..... 102/364
4,051,763 A * 10/1977 Thomanek ..... 89/36.17
4,359,944 A * 11/1982 Stiennon ..... 102/405
4,627,353 A * 12/1986 Chawla ..... 102/307
4,959,559 A * 9/1990 Ziolkowski ..... 359/896
5,497,704 A * 3/1996 Kurschner et al. ..... 102/264
5,792,978 A * 8/1998 Woodall et al. ..... 102/403
5,835,545 A * 11/1998 Turchi ..... 376/145

OTHER PUBLICATIONS

Air Defenses of World War II, Word War II Air Power, printed from internet site Http://www.ww2guide.com/flak.shtml on Mar. 7, 2005.*

Nauru, Stan Gajda, printed from internet site http://www.pacificwrecks.com/people/visitors/gajda/nauru.html on Mar. 11, 2005.*

* cited by examiner

*Primary Examiner*—J. Woodrow Eldred

(57) ABSTRACT

A synchronous or synergeticly timed fuse is installed into ordnance (bombs, artillery shells, depth charges etc.), the ordnance is delivered to a target area and a simultaneous (synchronous), or a synergetic (not neccessarily synchronous yet the energies add together to be greater than their individual parts), explosion event occurs. This explosion event can be enhanced by the shape the ordnance is configured in (a shaped charge on the order of meters or kilometers).

1 Claim, 12 Drawing Sheets

Synchronous by Vector

STFP
Blast
Wave
Redirected Blast wave
STFP Counter Blast wave
Redirected Blast wave
Enemy Troops OR Installation
Troops or installation to be Protected
Enemy Troops OR Installation STEP
Blast
Wave
Enemy Positions
Row 3
Row 2
Row 1
Troops or installation To Be Protected

SYNCHRONOUSLY/SYNERGETICLY TIMED FUSE PROCEDURE OR PROCESS

BACKGROUND OF THE INVENTION

1. Field of the Invention

This invention relates in general to militarily attacking a target and in particular to enhancing an attack's effects by synchronous or synergetic detonation of ordnance and enhancing an attack's effects by the geometric shapes said ordnance is applied.

2. Prior Art

Success in attacking enemy troops and installations can be the difference between life and death for our troops and our nation. Even with today's capabilities improvement is desired and necessary. With troops well dug in they can many times withstand hours or days of bombardment and still survive to fight. Deeply buried or hardened targets can, many times, survive our best efforts. It has long been known that the effects of a simultaneous salvo of artillery, as opposed to one at a time, or, a whole formation of aircraft, simultaneously dropping their bombs, as opposed to each aircraft dropping one at a time, has a different effect. Timed fuses have long been used—mainly to penetrate deeper into a material before exploding, or to harass aid and repair functions after the main bombing. They have not been used to create a synchronous or synergetic event. Shaped charges have been used since at least WWII—e.g. the bazooka round to concentrate forces to penetrate armor, or the claymore mine, to enhance directional effects. It has not been applied to how an artillery, aircraft or depth charge attack is laid out.

SUMMARY OF THE INVENTION

The object of the present invention is to provide a process to increase the desired effects on an enemy target. It is also an object to decrease the damaging effects on friendly forces or non targets.

The foregoing objects can be accomplished by providing a synchronously or synergeticly timed fuse system for ordnance applied. This can be accomplished by fitting each bomb, artillery shell, depth charge, or other ordnance with a time delay fuse. Each of these timed fuses would be set for a synchronous time or a synergetic event time. For example, one B52 flies 25 missions, or 25 B52s fly one mission and deliver one kiloton of ordnance to a target area—each bomb set on a preset fuse each fuse set to a preset synchronous time, or a preset synergetic event time—for instance, 5 minutes after the last bomb is dropped. Depending on the time tolerances of the fuses, an enhanced to an exponentiated effect can be expected. The foregoing can also be accomplished by the shape with which said ordnance is laid out. In the above example the B52s can lay out the ordnance in a chevron or triangle for a more directed blast. As another example, Synchronously Timed Fuse Procedure—or process—(abbreviated "STFP") artillery ordnance is fired into the protective layers over a hostile bunker, this time being arranged in a cone pattern—broadside of the cone facing the target, utilizing shaped charge technology, but again, on an exponentially larger scale than has been done before. The above 2 examples were synchronous and synergetic—there is also a non-synchronous yet synergetic approach to the matter. For example; the bombs laid out in a chevron pattern by the B52s could have 2 or more event times for the bombs to go off, to create a rolling detonation event. This would start at the point closest to friendly lines and progress out to the hypotenuse of the ordnance formation—which is closest to the enemy lines. With the earlier example of the artillery creating a cone above a hostile bunker, the detonation would start at the tip of the cone (closest to the ground) and progress down to the face of the cone (closest to the target). Furthermore, the spacings and timings of the STFP ordnance can be used to create novel and useful effects. Furthermore STFP ordnance can be mixed, including but not limited to, explosives with different expansion rates, incendiary, electro magnetic, chemical and nuclear ordnance.

BRIEF DESCRIPTION OF DRAWINGS

FIGS. 11-15 depict a "drill and wipe" sequence whereas; FIG. 11 is a top view and FIG. 12 is a side view of STFP ordnance applied above a buried, hardened target. FIG. 13 shows detonation of ordnance "A" at 0 seconds FIG. 14 shows detonation of "B" ordnance at 0+X seconds−X being the time it takes for explosion A to bring maximum material above ground level. FIG. 15 shows protecting material having been wiped to the side of the target.

DETAILED DESCRIPTION

This is a process where 2 or more bombs or other ordnance are delivered to an area and synchronously—that is simultaneously—or synergeticly—i.e. not necessarily simultaneously, yet with energies that add to each other—detonated.

Delivery can be accomplished through many means now available, including, but not limited to, artillery, missile, aircraft, depth charge, torpedo, or manual placement.

Detonation can be accomplished through several methods now available;

1. A timed fuse for each ordnance, each preset for the designated synchronous time, or for its' particular synergetic event time. The preseting can be done minutes, hours, days or years in advance.
2. A radio or electromagnetic fuse for each ordnance. The synchronous explosion would have all the fuses set for the same frequency and then all explode when that frequency is broadcast. The synergetic but non synchronous explosion would require each bomb or bombs with a different synergetic event time be given its' own frequency of fuse—these frequencies then broadcast at the appropriate synergetic event time.
3. Pressure or percussion fuses for each ordnance—these configured in series with a timed enabler so the fuse is enabled shortly before the time. These then initiated by 1 or 2 above, or by a standard artillery shell, bomb, depth charge, or other ordnance.
4. A combination of 1,2 and 3, above run in parallel for a more certain detonation event.

Placing the ordnance into the geometric shapes desired can be accomplished through well known, extant techniques such as, the trigonometry formulas an artillery officer uses to calculate his trajectory, the mathematical formulas a bombardier uses to drop unguided bombs, laser guided munitions technology, Global Positioning System guided munitions technology, cruise missile technology ballistic missle technology, guided and unguided torpedo technology, manual placement and other extant technologies. Where depth is a consideration for the munitions placement such as into the protective layers above a buried target, presently available ordnance with various penetration capabilities can be applied.

Figure 1:
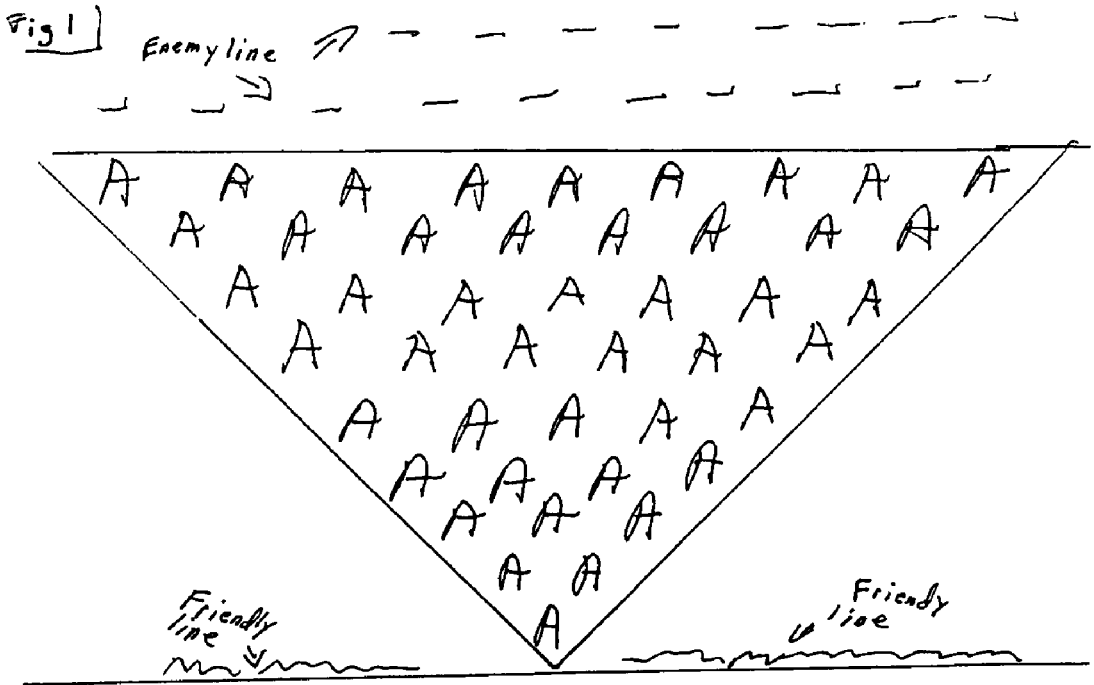
FIG. 1 is a top view of a field of STFP ordnance laid out in a triagular shaped charge pattern. Each "A" in the triangle represents a bomb set to a simultaneous detonation time.
Figure 2:
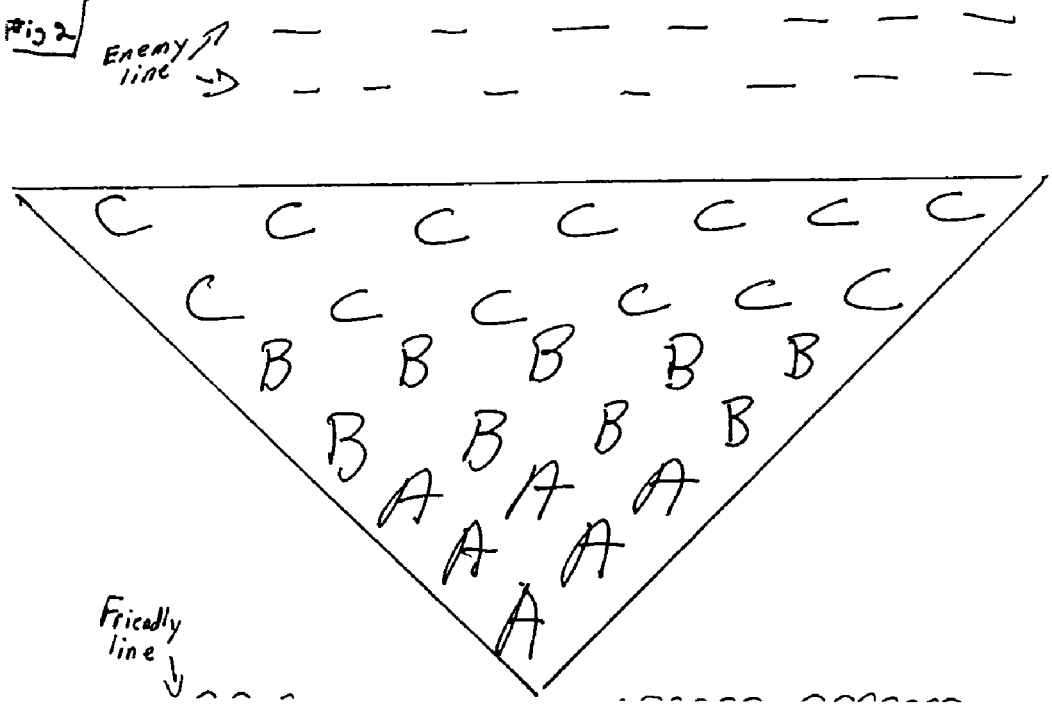
FIG. 2 is a top view of a field of STFP ordnance laid out in a triangular pattern, Each "A" represents a bomb timed to go off at 0 seconds, each "B" a bomb to go off at 0+X seconds and each "C" a bomb to go off at 0+2X seconds. For example 0 seconds, 0.25 seconds, and 0.5 seconds.
Figure 3:
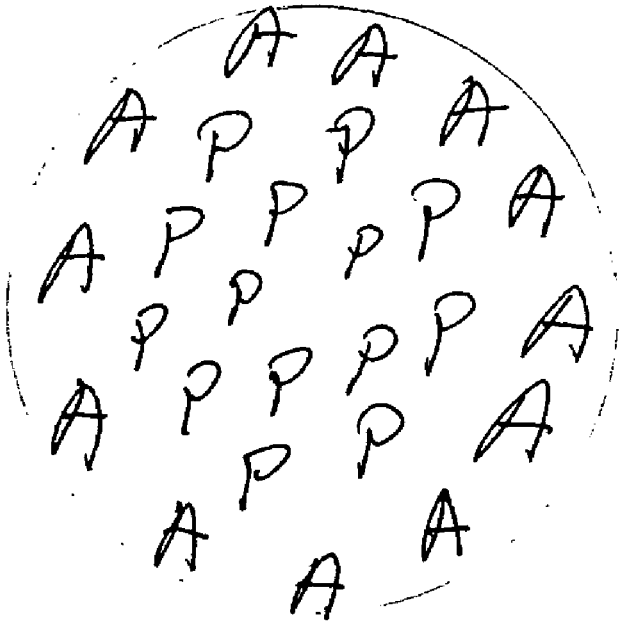
FIGS. 3 and 4 are top views of mixed fuse STFP ordnance where "A" are preset timed fuses and "P" are bombs with a percussion or pressure activated fuse.
Figure 4:
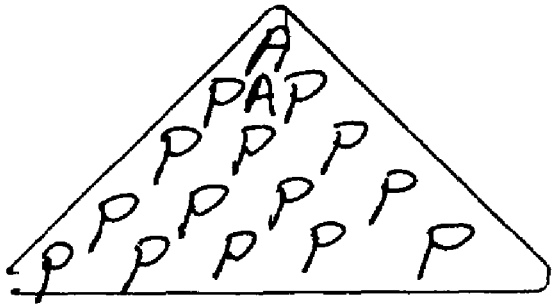
Figure 5:
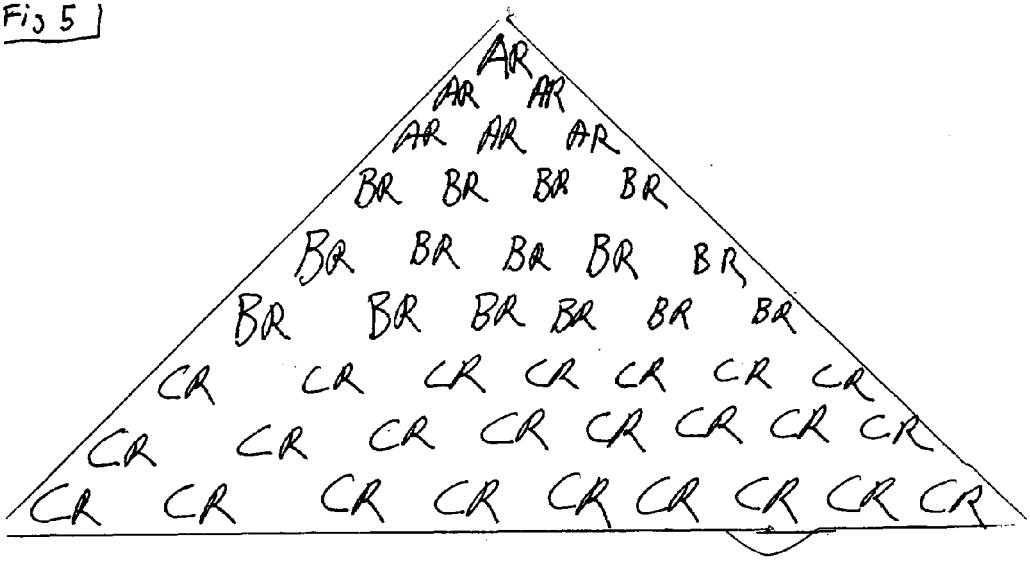
FIG. 5 is a top view of electromagnetic fused ordnance of frequencies A,B and C, "AR" a radio actuated fuse of frequency A, "BR" a radio activated fuse of frequency B, "CR" a radio activated fuse of frequency C. Frequecy A broadcast at 0 seconds, frequency B broadcast at 0+X seconds, frequency C broadcast at at 0+Y seconds.
Figure 6:
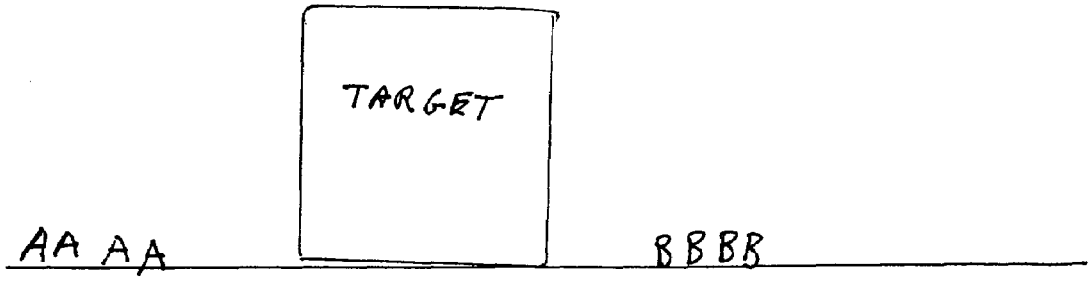
FIG. 6 is a side view of a target and STFP ordnance. "A" ordnance goes off at 0 seconds, "B" goes off at 0+X seconds, where x equals sway back or bounce back time of building from explosion A.
Figure 7:
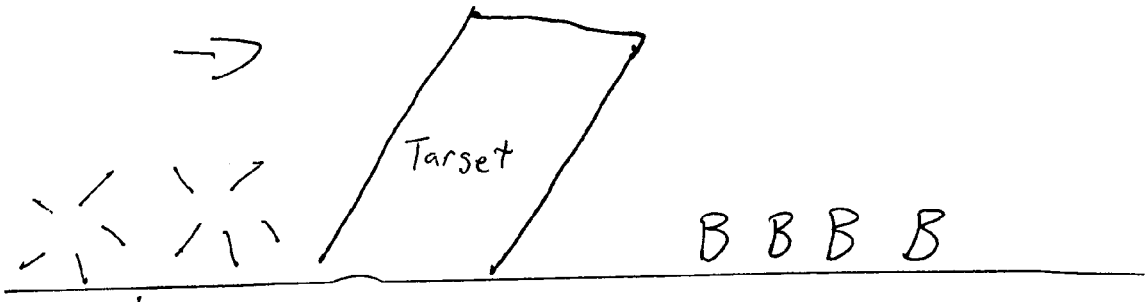
FIGS. 7+8 are a continuation of FIG. 6 where the target is rocked one way and then the other.
Figure 8:
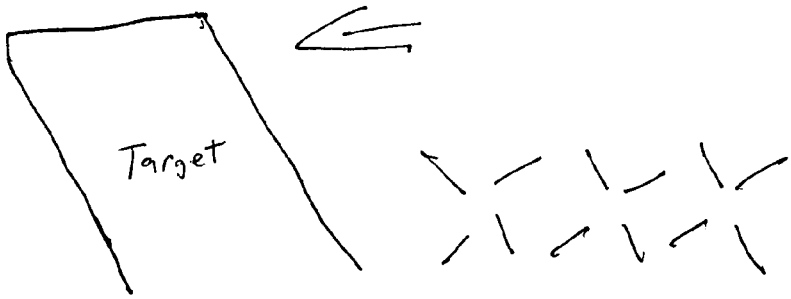
Figure 9:
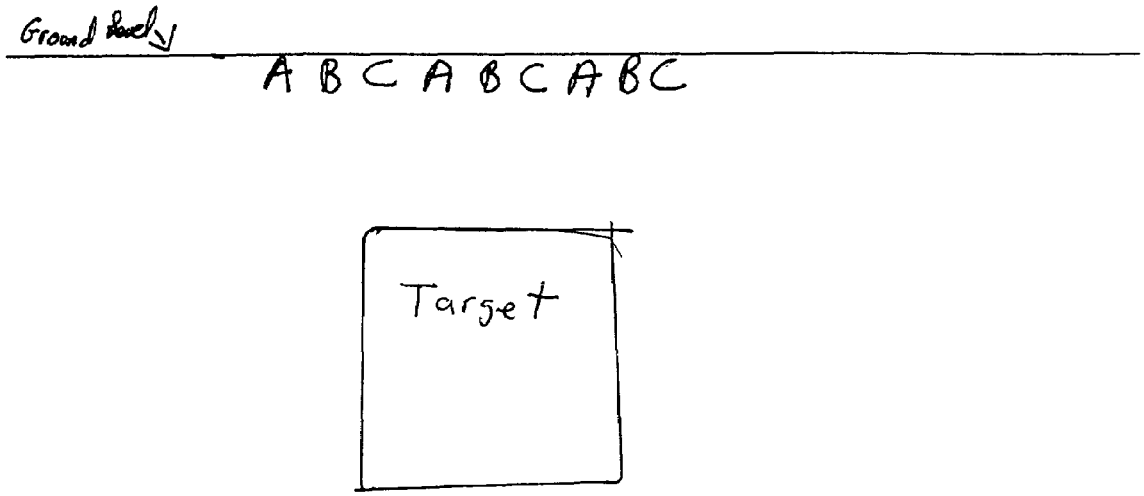
FIG. 9 is a side view of STFP ordnance over a target. "A" goes of at 0 seconds, "B" goes off at 0+X seconds, and "C" goes off at 0+2X seconds, and X=maximum bounce back or rebound of the target.

Applications of STFP would include, but not be limited to;

A. Simple, simultaneous (synchronous) detonation of ordnance. This is where 2 or more (2 times 10 to the X power) bombs, attillery shells or other STFP ordnance are applied to a target area, over a period of time, for a synchronous detonation. Conventional explosives, incendiary biological, chemical, electromagnetic, or nuclear ordnance could apply. The closer in time the ordnance goes off the greater the chance for synergetic events. These events would include motion, pressure, electromagnetic and chemical reaction. These events would also include degredation of the atmosphere. These events can be enhanced by the geometric patterns the ordnance is laid out See FIG. 1

B. Rolling Technique; This would utilize a rolling detonation pattern The detonation would start at the friendly or neutral side and progress out to the target. This, expanding in time the shock wave is experienced at the friendly side and thus mitigating the effects. See FIGS. 2,3,4,5 and 19.

Figure 10:
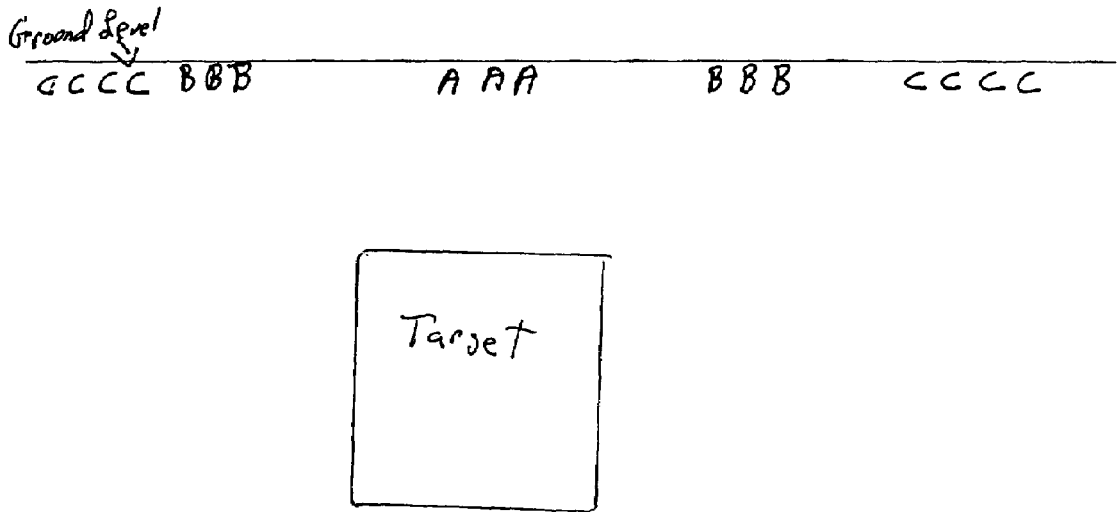
FIG. 10 is a side view of STFP ordnance timed for a synchronous by vector approach where "A" goes off at 0 seconds, "B" goes off at 0−X seconds, and "C" goes off at 0−Y seconds, where X=the difference in time for the energy from explosions A and B to reach the target, and Y=the difference in time for the energy from explosions A and C to reach the target.
Figure 11:
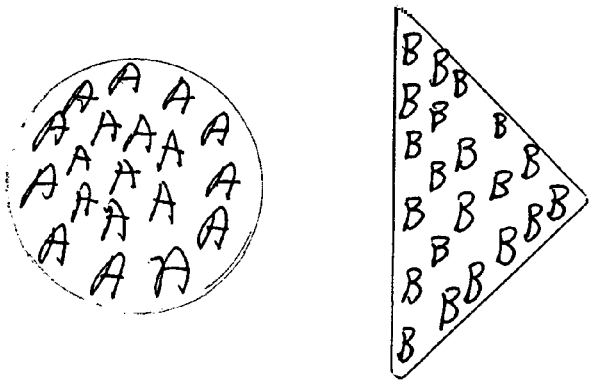
Figure 12:
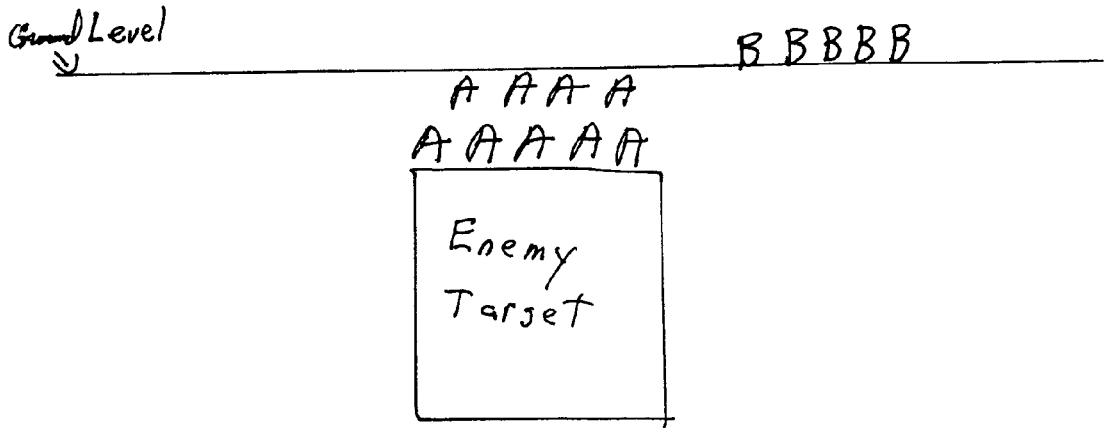
Figure 13:
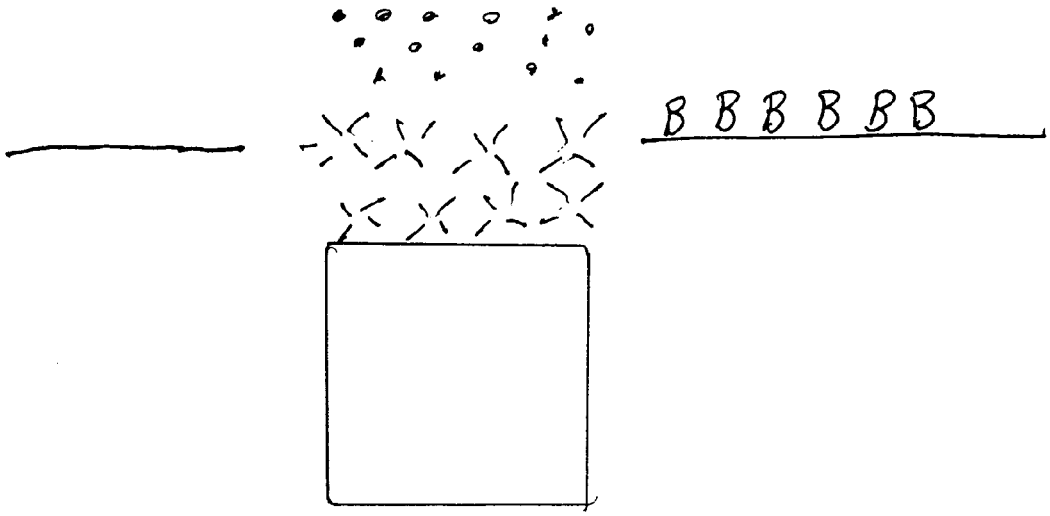
Figure 14:
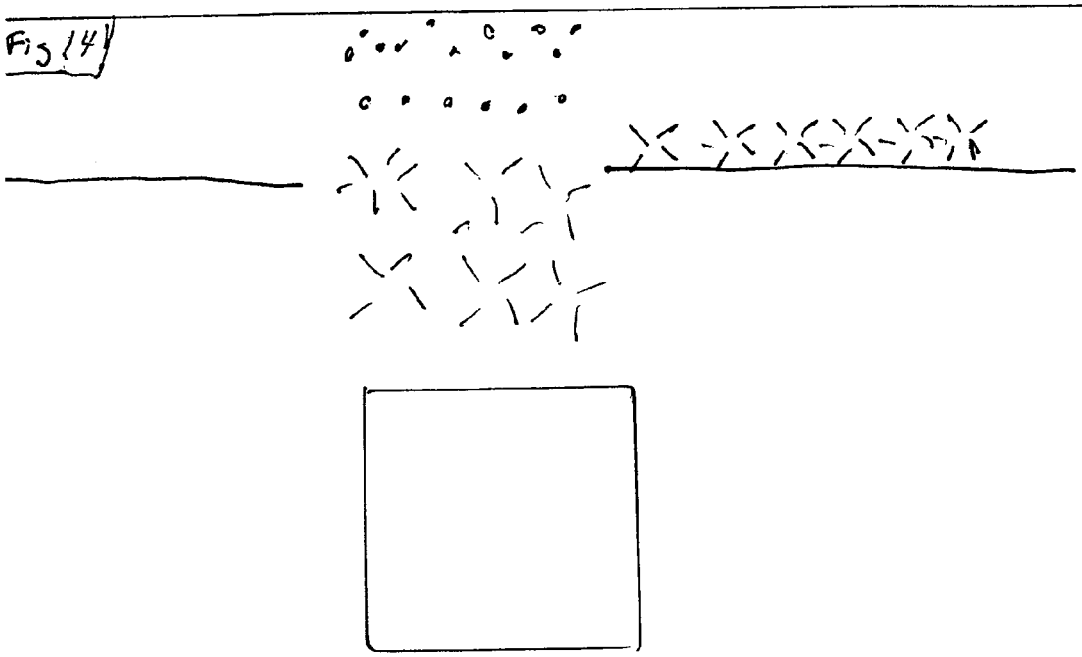
Figure 15:
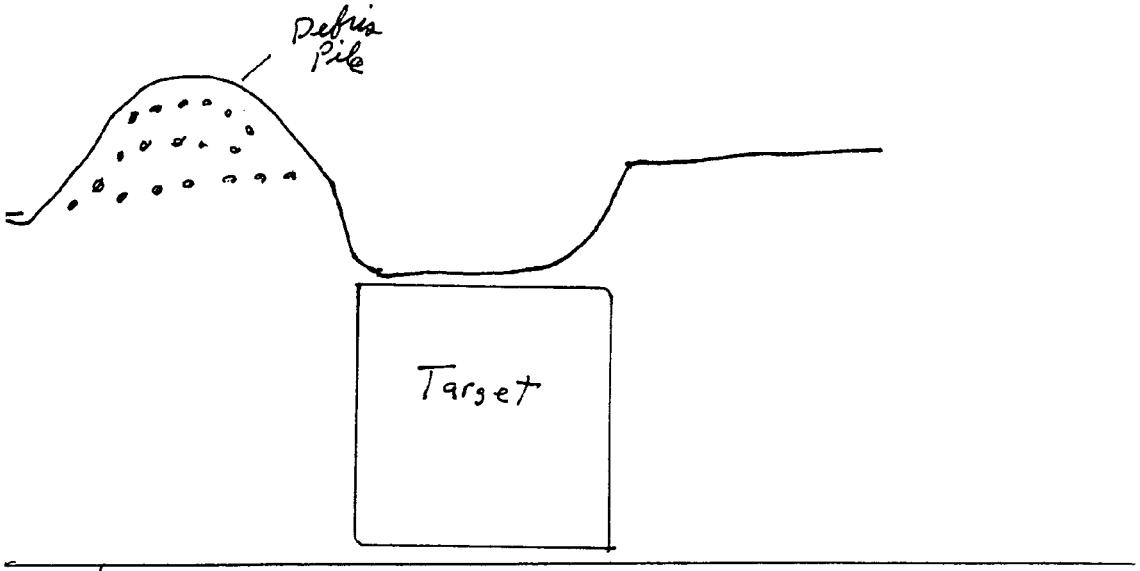

C. Simultaneous by vector; In this, the detonation is ruled by when the main energy wave arrives at the target. This, of course, would be ruled by distance from target, material energy is traveleling through, and type of energy being synergised—that is—, electromagnetic pulse being synergised would require a different calculation than a pressure wave travelling at the speed of sound. There would be a difference in detonation times but simultaneous arrival of the main pressure waves or other energies. See FIG. 10.

D. Rhythm or bouncing technique; In this application the majority of reactionary or "bounce back" forces are calculated for the particular target and intervening material. The synergeticly timed ordnance is then detonated in a rhythmic sequence taking advantage of this. See FIGS. 6,7,8, and 9

E. Drill and wipe procedure; In this application the synergeticly timed and placed ordnance would be used to dig out and expose a buried target. It would be applied in 2 sets. Set A is applied into the ground or material above a target. Set B is applied above and to the side of set A at ground level. Set A ordnance blows up first, moving the protective layers above the target up into the air. Set B detonates next wiping the material to the side. This process is continued until the target is exposed for final attack sequence. The timing difference between the drill ordnance (Set A) and the wipe ordnance (Set B) will vary due to factors such as, size of the explosion and expansion rate of explosives used.

Figure 16:
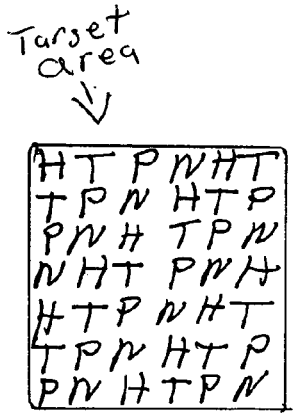
FIG. 16 depicts a mix where "H" is high explosive, "T" is thermite, "P" is white phosphorous, and "N" is napalm configured on STFP. H goes off at 0 seconds, T goes off at 0−X seconds, P goes off at 0−Y seconds, and N at 0−Z seconds, where X,Y, and Z are the respective times it takes for that incendiary to heat to maximum temperature.

F. STFP with incendiary technique; In this application incendiary is mixed in or placed at the center, or in front of, explosive ordnance. The target then being heated and pressuriized the incendiaries going off first, heating to maximum, then the explosive to pressurize. See FIGS. 16 and 17.

G. STFP for enhanced electromagnetic effect technique; This can be accomplished by using the method now used—creating an electric field and collapsing it with explosives—except using STFP configuration we can now dial up several orders of magnitude. See FIG. 1 and 2—except with electromagnetic ordnance instead of explosive.

H. Multiple expansion rate explosion; In this application explosives with different expansion rates are applied (for example, T.N.T., black powder and a fuel/air explosive). See FIG. 2—except with A,B,C, are explosives with different rates of expansion.

Figure 17:
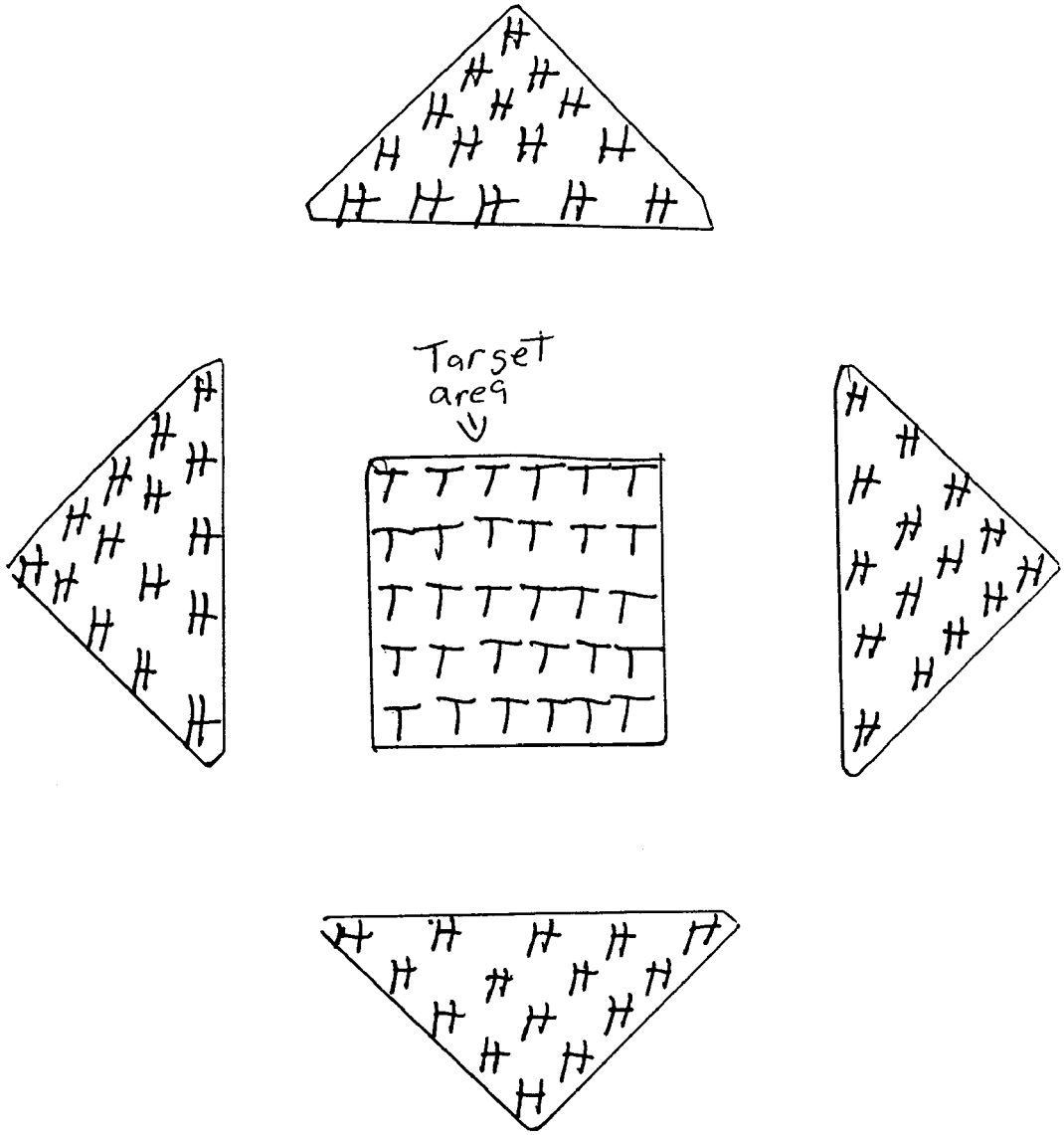
FIG. 17 depicts a mixed ordnance of STFP ordnance where "T" is thermite, and "H" is high explosive. H goes off at 0 seconds and T goes off at 0−X seconds, X being the time it takes the thermite to reach maximum temperature.

H. Enhancement/attenuation of chemical and biological attacks technique; This can be accomplished through STFP configured ordnance in the following ways; Enhancing a chemical's reaction by exposing the target to your reacting agent and then pressurizing with an explosion to increase the reaction rate—exampled in FIG. 2, configured where A and B are still explosive ordnance, and go off at their respective times, C stands for chemical ordnance that goes off before the explosive and gets pushed into the enemy target; Defense can be accomplished through oxidizing or reducing the enemy chemical agent. FIG. 17 demonstrates such an application where the T or thermite is applied in the middle of target chemical. To this can be added oxidisng or reducing agents, or other chemical reactants. Further, this procedure could be used to target biological agents.

Figure 18:
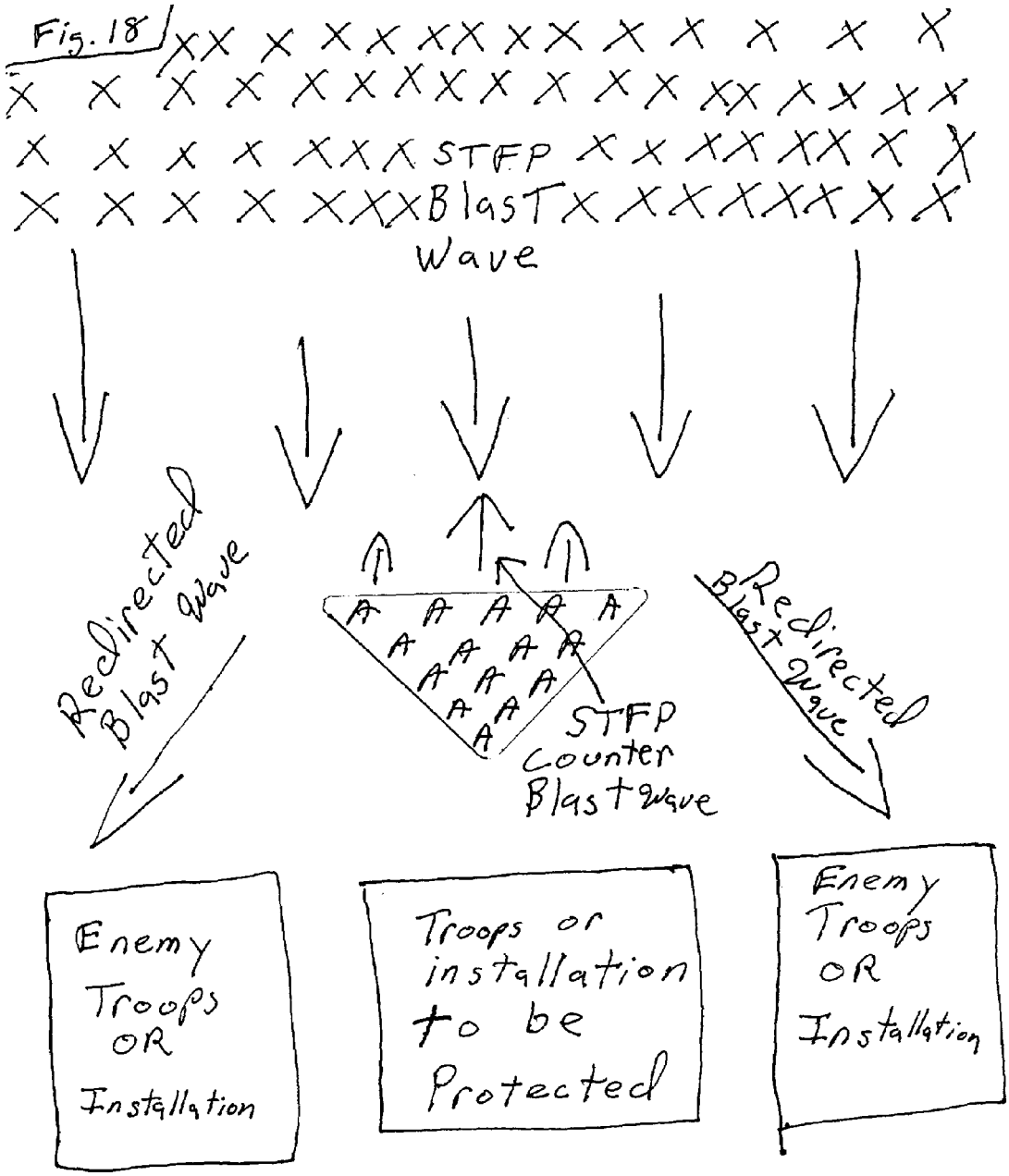
FIG. 18 depicts defilading or protecting of a small area against a larger STFP blast, where "X" and "A" are STFP ordnance. X goes off at 0 seconds and "A" goes off at 0+Y seconds, where Y=time it takes blast wave from X ordnance to reach the protected area.
Figure 19:
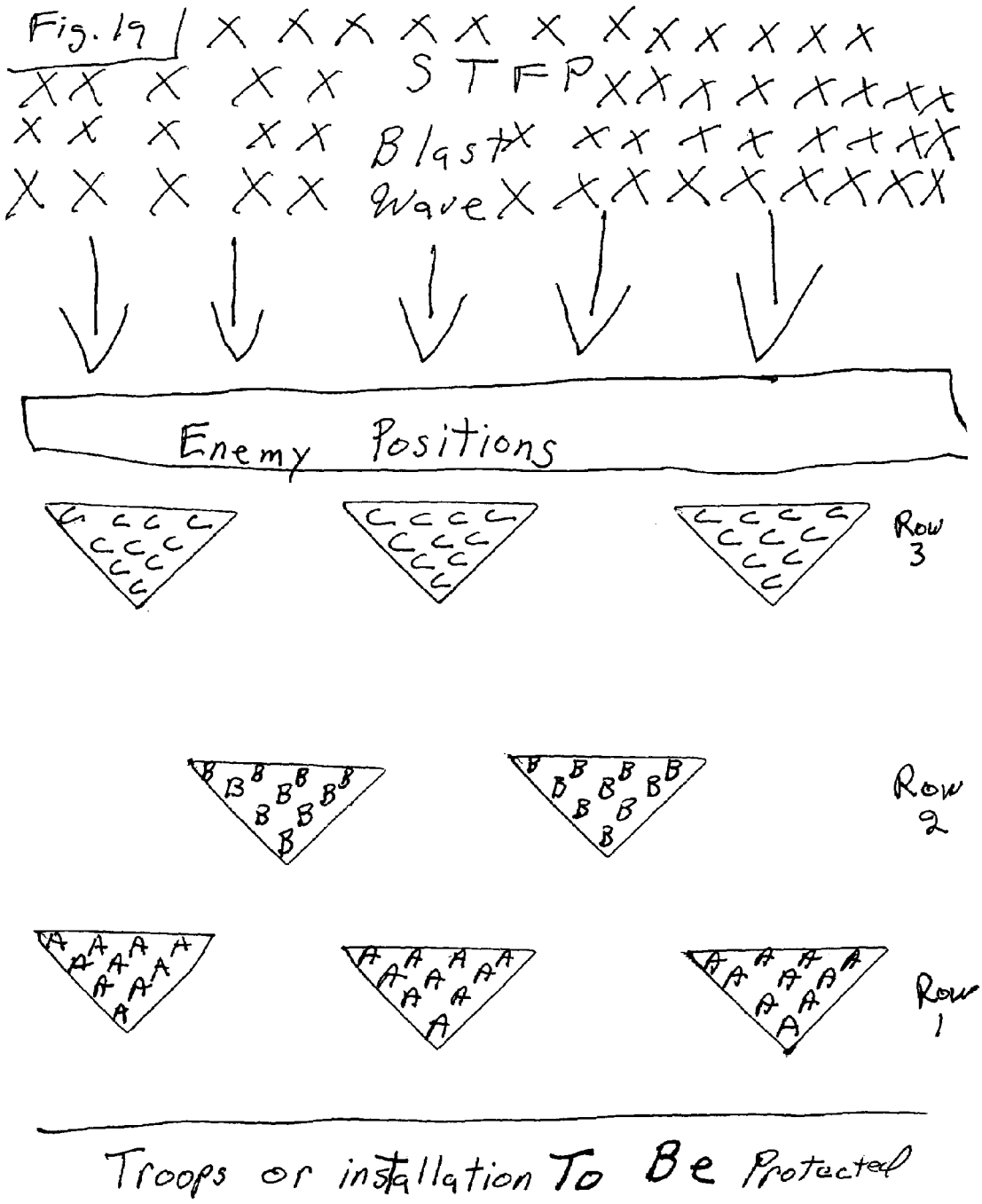
FIG. 19 depicts a baffle pattern approach, where "X" "A", "B", and "C" are STFP ordnance. X goes off at 0 seconds, A goes off at 0+N seconds, B at 0+2N seconds, and C at 0+3N where N is the time it takes for the counter blast wave to reach from row 1 to row 2, and from row 2 to row 3 and 3N is less than the time it takes blast wave X to approach the protected area.

I. Defilade by STFP technique; In this application, STFP ordnance is used to counter blast other STFP ordnance thus protecting friendly troops or structures. The counter blast STFP ordnance would be arrayed and timed for the particular main blast configurement of STFP ordnance and the particular area to be protected. See FIGS. 18 and 19.

What is claimed is:

1. A process of creating an enhanced explosion event comprising:

providing a first plurality of explosive ordnance, each comprising a preset synchronously timed fuse;

providing at least a second plurality of explosive ordnance, each comprising one of a percussion or a pressure activated fuse and a timer to enable the fuse prior to activation of the synchronously timed fuses of the first plurality of ordnance;

delivering the first plurality of ordnance in a first predetermined perimeter with a first diameter;

delivering the second plurality of ordnance in a second predetermined perimeter with a second diameter, where the second diameter is smaller than the first diameter;

whereby the explosion of the first plurality of ordnance due to the synchronously timed fuses results in the explosion of the second plurality of explosive ordnance.

* * * * *